United States Patent [19]

Gastine

[11] 4,286,690

[45] Sep. 1, 1981

[54] ESCAPE DEVICE

[75] Inventor: Roland E. Gastine, Bedford, Tex.

[73] Assignee: Commercial Management Corporation, Fort Worth, Tex.

[21] Appl. No.: 17,285

[22] Filed: Mar. 5, 1979

[51] Int. Cl.[3] ..... A62B 1/06

[52] U.S. Cl. ..... 182/5

[58] Field of Search ..... 182/5, 6, 7, 74; 254/153, 152, 151, 154, 159

[56] References Cited

U.S. PATENT DOCUMENTS

| | | | |
|---|---|---|---|
| 1,167,239 | 1/1916 | Winkler | 254/152 |
| 1,490,524 | 4/1924 | Wood | 182/6 |
| 4,063,615 | 12/1977 | Knepp | 182/5 |

*Primary Examiner*—Reinaldo P. Machado
*Attorney, Agent, or Firm*—James E. Bradley

[57] ABSTRACT

An escape device for allowing an individual to descend from a damaged building. A drum and cable is mounted in a housing. The free end of the cable is secured to a part of the building, allowing the user to descend as the cable plays out and the drum rotates. A multiple gear reduction train mounted to the drum automatically limits the descent speed. A coil spring shock absorber forms the connection between the drum and gear train to reduce shock. A strap is folded inside a separate compartment in the housing below the drum and gear train. The strap is placed about the user's body during the descent. A quick release door in the strap compartment provides access to the strap.

14 Claims, 3 Drawing Figures

ESCAPE DEVICE

BACKGROUND OF THE INVENTION

1. Field of the Invention:

This invention relates in general to fire escape devices, and in particular to a drum and cable unit for lowering an individual from a damaged structure.

2. Description of the Prior Art:

Many deaths result each year from building fires in which people are trapped in floors too high to be reached by fire truck ladders. There have been many proposals in the patented art to provide fire escape devices. One common proposal is a small portable drum and cable kept in higher floors for emergency use. Should fire occur, the user breaks a window, secures the free end of the cable to a building part, then lowers himself to the ground or to a safe level.

One deficiency with some of the proposals, such as shown in U.S. Pat. No. 859,266 issued to Ulery and U.S. Pat. No. 2,409,767, issued to Larson, is that the user has to adjust a friction type brake to control the speed of descent. Should the user panic or be unconscious, an accident may occur. Other proposals disclose automatic governors for speed, such as shown in U.S. Pat. No. 2,500,884 issued to Tessin and U.S. Pat. No. 4,063,615 issued to Knepp. Tessin utilizes a fluid restricting device that requires reverse winding of the cable and the drum at periodic points. Knepp utilizes a centrifugal friction type governor in which additional speed control appears to be required through manual operation of a conventional brake band.

Also, none of these devices shown appear to have means provided to absorb shock due to jerking of the line. If the user jumps, as is likely, the jerk might part the line or damage the speed governor. In U.S. Pat. No. 939,375 issued to Andrews, a coil spring is disclosed that winds more tightly as the user descends so that the unit can return to the upper level once the user reaches ground and releases it. Possibly the spring will also absorb some shock, however, the speed control is manual.

In addition, none of the patents disclose a compact package for storage. Rather the straps for supporting the body are hanging loose from the carriage, making it easy for them to tangle, and also more bulky to store.

SUMMARY OF THE INVENTION

It is a general object of this invention to provide an improved individual escape device of the cable and drum type.

It is a further object to provide an improved individual escape device of the cable and drum type with a speed governor that does not rely on fluid restriction or frictional contact.

It is a further object of the invention to provide an improved individual escape device of the cable and drum type with means to absorb shock due to jerking of the cable.

It is a further object of this invention to provide an improved individual escape device of the cable and drum type in which the straps for the user's body are foldable in a compact unit, with the drum and speed governor constructed to allow the straps to be quickly drawn into position for use.

In accordance with these objects, an improved individual escape device is provided that employs a drum and cable. A multiple gear reduction train is rotated by the drum. The high speed member in the train is weighted sufficiently to prevent excess drum speed. A coil spring is mounted between the drum and the gear train, transmitting rotational motion and absorbing shock. The drum, cable and gear train are mounted in an upper compartment. A lower compartment contains the folded strap for the user. A hinged door at the bottom of the lower compartment has a quick release fastener to allow the strap to fall out for use.

DESCRIPTION OF THE PREFERRED EMBODIMENT

Figure 1:
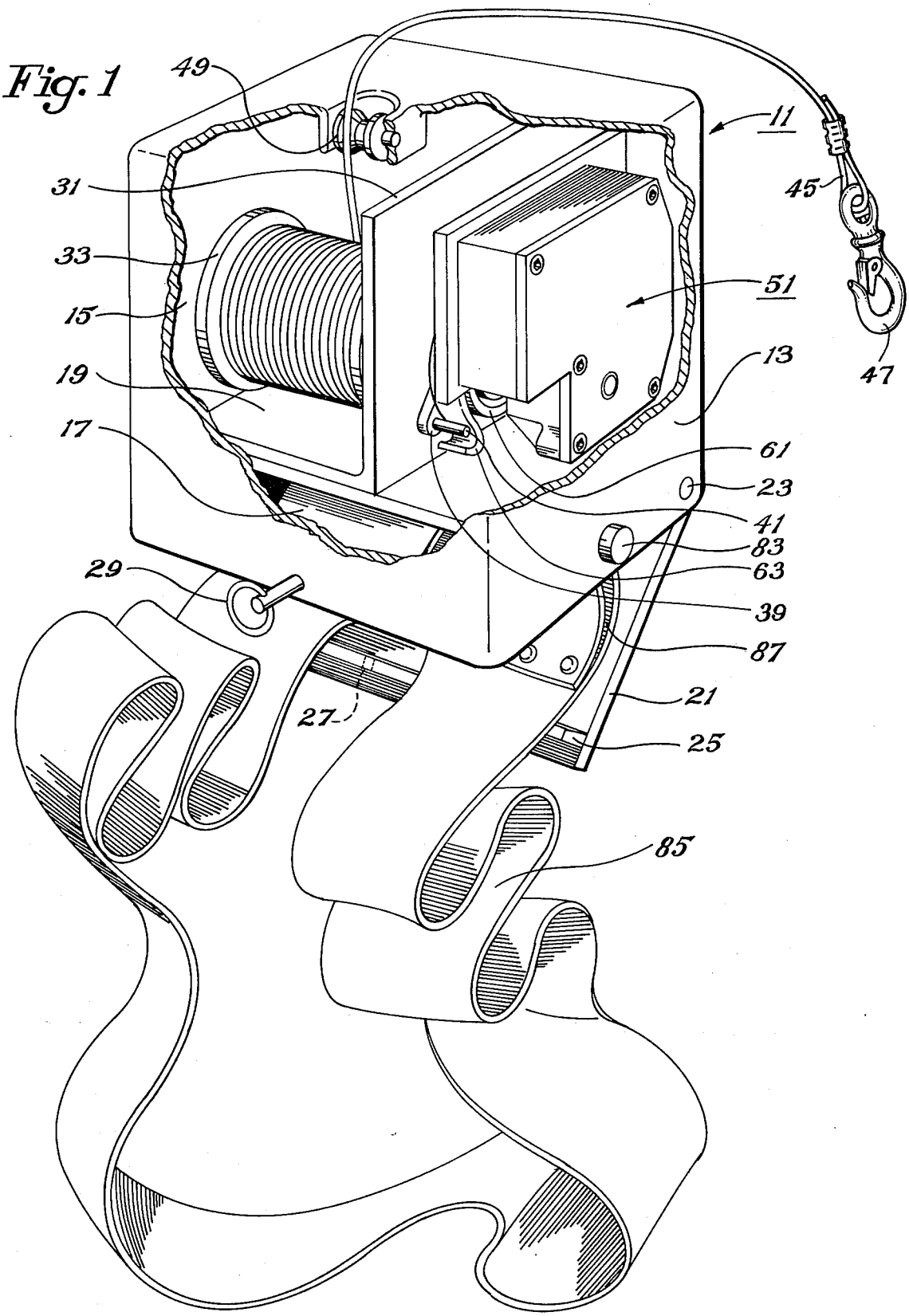
FIG. 1 is a perspective view, partially broken away, showing an escape device constructed in accordance with this invention.
Figure 2:
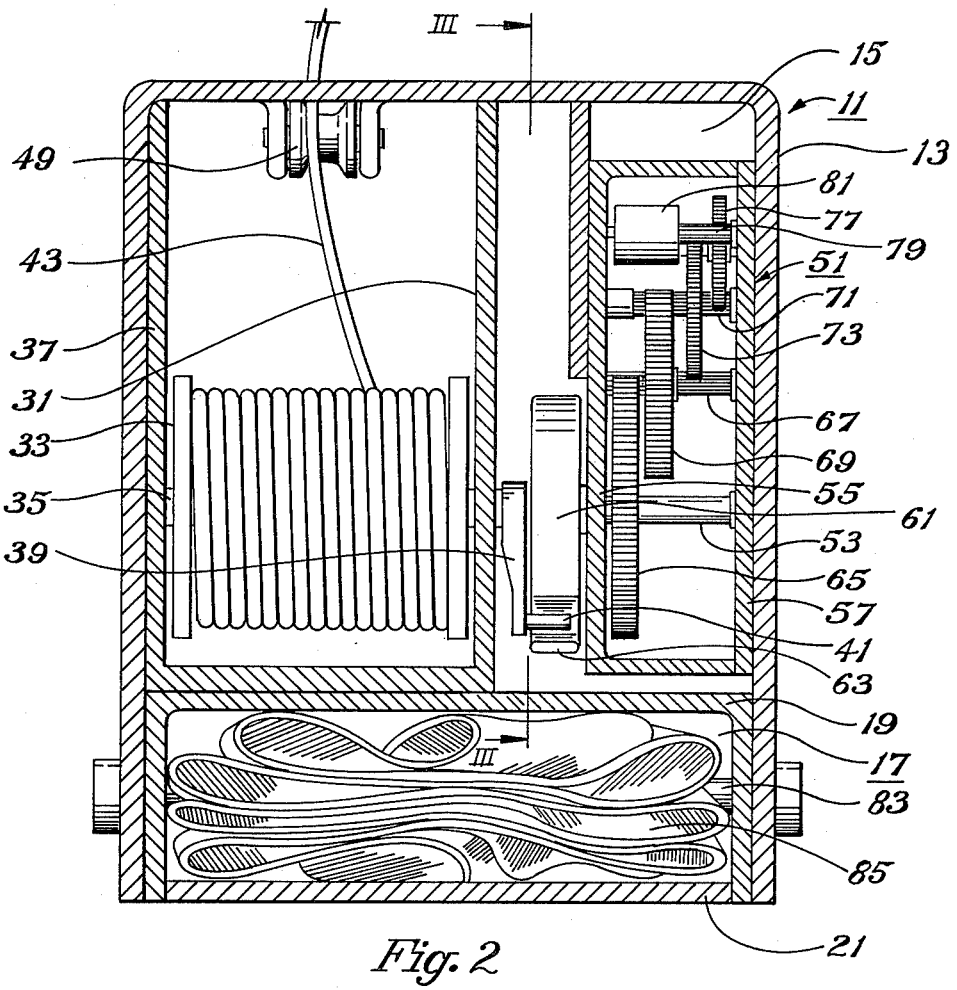
FIG. 2 is a vertical sectional view of the escape device of FIG. 1, with the strap folded into the storage position.

Referring to FIG. 1, escape device 11 includes a carriage comprising a rectangular housing 13. Housing 13 is divided into a first or upper compartment 15 and a second lower compartment 17, separated by a horizontal partition 19. A door 21 forms the bottom of the lower compartment 17. A hinge 23 connects one side of door 21 to the back wall of housing 13. An upright flange 25, mounted to door 21 on the upper side and opposite hinge 23 fits inside of the housing 13 front wall when the door 21 is in the closed position, shown in FIG. 2. An aperature 27 extends through the center of flange 25. A pin 29 extends slidably through an aperture in the front wall of housing 13 to engage aperture 27. Pin 29, flange 25 and hinge 23 serve as fastener means for releasably securing the door 21 to the housing 13 in a closed position as shown in FIG. 2.

A vertical partition 31 divides upper compartment 15 into two sections. In the left section, or subcompartment, a reel or drum 33 is rotatably mounted. Referring to FIG. 2, drum 33 is mounted on an axle 35 for rotation therewith and with respect to housing 13. Axle 35 is rotatably mounted into vertical partition 31 on the right, and into another vertical wall 37 on the left. An arm 39 is secured to axle 35 for rotation with the axle and drum 33. Arm 39 extends perpendicular to axle 35 for a distance approximately ½ the drum diameter. A pin or finger 41 extends from the free end of arm 39 perpendicular to it and away from drum 33. Arm 39 and finger 41 comprise the output member in drum 33.

A small diameter steel cable 43 capable of holding about 1500 pounds is wound around drum 33. Cable 43 has an inner end (not shown) secured to drum 33 and an outer or free end 45 secured to a hook 47 outside of housing 13. Hook 47 is for securing to an eyelet (not shown) mounted inside the building at an appropriate place. Alternately, end 45 may be affixed to a permanent connection in a hallway storage cabinet where fire extinguishing equipment is normally kept. Cable 43 passes through an aperture in the top of housing 13, guided by a guide roller 49 mounted to the inner side of the top of housing 13. Roller 49 is spool-shaped and rotates with respect to housing 13 as the cable 43 plays out. The length of cable 43 is selected to be sufficient for the user to reach the ground or a safe lower level. Cable 43 is wound around drum 33 only in a single direction. A sheath or enclosure (not shown) may be mounted about drum 33 to prevent uncoiling of the cable 43 when no tension is on the cable.

A speed governor 51 or retarding means for limiting the rotational speed of drum 33 during descent of device 11 is located on the right side of partition 31. Partition 31 divides the upper compartment 15 into a drum compartment on the left and a governor compartment on the right. Speed governor 51 comprises a multiple gear reduction train of the type commonly used to reduce the rotational speed of electrical motors and increase their torque.

Figure 3:
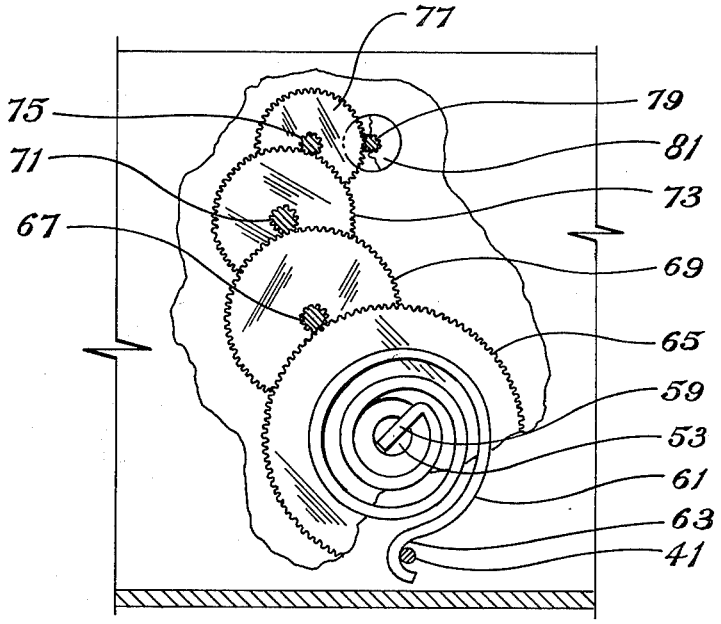
FIG. 3 is a sectional view of the escape device of FIG. 1, partially broken away, and taken along the line III—III of FIG. 2.

Referring to FIGS. 2 and 3, gear train 51 has a low speed input member or shaft 53 coaxially aligned with drum axle 35. Input shaft 53 is journaled between two vertical walls 55 and 57 of a subhousing for the gear train 51. Input shaft 53 has a transverse slot formed on its end closest to drum 33. This slot closely receives the straight and inner end portion 59 of a coil spring 61.

Coil spring 61 is a flat band of spring steel formed into a coil, and serves as shock absorber means for absorbing shock due to jerking of the cable. The outer end 63 is bent into the shape of a hook to be engaged by finger 41 of arm 39. Spring 61 lies in a plane normal to the drum axle 35. Spring 61 is wound clockwise from the inner end 59 to the outer end 63 when viewed as in FIG. 3. Unwinding cable 43 tends to wind or compress spring 61 into a tighter coil. The stiffness or bias of spring 61 is selected so that under torque exerted by a user of the heaviest weight expected, a substantial amount of further compression or winding will still be possible. Spring 61 absorbs shocks from jerks on the cable 43 by further compressing, thus not transmitting the rapid acceleration due to jerks to the speed governor.

The intermediate members of the gear train 51 include a first spur gear 65 mounted to input shaft 53 for rotation therewith. Gear 65 is located between vertical walls 55 and 57 and on the left side. A pinion 67 is mounted in engagement with gear 65. Pinion 67 comprises a shaft journaled between walls 55 and 57, and having longitudinal splines that mesh with the teeth on gears 65. A second gear 69, smaller than the first gear 65, is mounted on pinion 67 for rotation therewith. Second gear 69 has teeth that mesh with a second pinion 71. A third gear 73, smaller than the second gear 69, is mounted on the second pinion 71 for rotation therewith. Third gear 73 engages a third pinion 75. A fourth gear 77, smaller than the third gear 73, is mounted on third pinion 75 for rotation therewith. Fourth gear 77 engages a fourth pinion 79. A cylindrical balance or weight 81 is mounted to fourth pinion 79 for rotation therewith. Balance 81 is the highest speed member of the gear train 51 and comprises a solid cylinder, except for the hole through which the fourth pinion 79 extends. Pinions 67, 71, 75 and 79 are parallel with drum axle 75, are journaled between walls 55 and 57, and all have longitudinal splines for engaging gear teeth. In FIG. 3, balance 81 is shown partially broken away.

Referring to FIG. 2, the body support means for carrying the user during descent includes a transverse bar 83 extending between the sidewalls of housing 13 in the lower or strap compartment 17. As shown in FIG. 1, a nylon strap 85 has two ends (only one shown) that are formed into loops 87 for receiving bar 83. Strap 85 defines a loop for placing around the user's arms and around his chest for descending.

In operation, should a fire occur, the user breaks or opens a window. He then clips cable hook 47 to an eyelet in the building previously provided, unless the end 45 is already permanently affixed to some component in the building. The user then pulls out sufficient cable 43 to be near the open window. He pulls pin 29, which releases door 21 to the open position, as shown in FIG. 1, allowing strap 85 to fall out. He places strap 85 around his chest and under his arms, and jumps or drops out the window. As he descends, cable 43 turns drum 33, playing out the cable. Drum 33 rotates arm 39, which rotates coil spring 61 and the speed governor input shaft 53 through finger 41. Shock from the jump or other jerks will tend to further wind spring 61. This absorbs some of the shock on the cable 43, and also the shock that otherwise would be transferred to the gear train 51.

Input shaft 53 of gear train 51 will be rotated at the same speed as drum 33. Shaft 53 rotates the first gear 65 at the same rotational speed. Being considerably larger than the pinions, first gear 65 rotates pinion 67 at a considerably higher rotation speed. First pinion 67 drives the second gear 69 at this higher speed. Second gear 69 rotates the second pinion 71 at a still greater speed, since it is larger in diameter than pinion 71. Pinion 71 drives third gear 73 at this speed. Third gear 73 drives third pinion 75 at a higher speed since it is larger in diameter than pinion 75. Pinion 75 drives fourth gear 77 at this higher speed, which in turn drives the fourth pinion 79 and weight 81 at the highest rotational speed. Due to the multiple gear reduction from weight 81 to first gear 65, the speed of the user will reach a fairly safe velocity until the user reaches ground. No handbrake is needed,although one could be provided if desired.

The descending velocity of the user depends to a great extent on the mass of weight 81. Weight 81 is selected so that the descent speed will accelerate only to a safe, substantially constant velocity. The velocity will depend on the weight of the user, and also varies as the cable unwinds, and the safety drum diameter decreases.

To provide a selected safe velocity with a 20 to 500 pound load, the gear train had the following dimensions, First gear 65—1 $\frac{7}{8}$ inch diameter—73 teeth
First pinion 67—5 1/16 inch diameter—10 teeth
Second gear 69—1 $\frac{1}{4}$ inch diameter—62 teeth
Second pinion 71—$\frac{1}{4}$ inch diameter—8 teeth
Third gear 73—1 $\frac{1}{8}$ inch diameter—55 teeth
Third pinion 75—$\frac{1}{4}$ inch diameter—8 teeth
Fourth gear 77—1 inch diameter—66 teeth
Fourth pinion 79—$\frac{1}{8}$ inch diameter—8 teeth
Weight 81—$\frac{5}{8}$ inch diameter—One Half Pennyweight of 0.77 grams
Steel cable 3/32 inch diameter.

When fully wound, the drum diameter was about 2 $\frac{1}{2}$ inches. Under a 260 pound load, the velocity was a safe level of about $\frac{1}{2}$ foot per second.

It should be apparent that an invention having significant advantages has been provided. The escape device has a speed governor that effectively and sensitively governs speed without the need for a fluid restriction device or friction contact. No manual brake is necessary. Shock on the cable is reduced by the shock absorber, avoiding damage to the cable and to the speed governor. The housing allows the strap to be compactly folded for storage.

While the invention has been shown in only one of its forms, it should be apparent to those skilled in the art that it is not so limited but is susceptible to various changes and modification without departing from the spirit thereof.

I claim:

1. An escape device for allowing a user to descend from a damaged structure, comprising in combination:

a housing having a drum compartment and a strap compartment separated from each other by a partition, the strap compartment having a door releasably mounted to the housing;

a drum rotatably mounted to the housing inside the drum compartment;

a cable wound around the drum and extending through an opening in the top of the drum compartment, the cable having an end adapted to be secured to a part of the structure;

a strap having its ends secured to the housing to form a loop for the user to place about his body for descending with the housing, the strap being foldable inside the strap compartment; and shock absorber means connected between the drum and the retarding means for absorbing shock due to jerking of the cable to reduce the shock being transmitted to the retarding means.

2. The device according to claim 1 wherein the drum has an output member and the retarding means has an input member, and the shock absorber means comprises a coil spring located between the output member and the input member for transmitting the rotational motion of the output member of the drum to the input member of the retarding means.

3. In an escape device for allowing a user to descend from a damaged structure of the type having a carriage, a drum rotatably mounted to the carriage, a cable wound around the drum and having an end adapted to be secured to a part of the structure, body support means carried by the carriage for carrying the user during descent, and retarding means mounted to the carriage for limiting the rotational speed of the drum during descent of the carriage and the user, the improvement comprising:

shock absorber means mounted between the drum and the retarding means for absorbing shocks due to jerking of the cable to reduce the shock being transmitted to the retarding means.

4. The device according to claim 3 wherein the shock absorber means comprises a coil spring mounted between an output member of the drum and an input member of the retarding means.

5. The device according to claim 4 wherein the drum output member comprises an arm mounted to the drum for rotation therewith, and a finger extending from the end of the arm and in engagement with the outer end of the coil spring, the inner end of the coil spring being secured to the retarding means input member for rotation therewith, so that rotation of the drum rotates the arm, which in turn rotates the spring and the retarding means input member, the descending rotation of the drum tending to tighten the coil of the spring and being resisted by the bias in the spring.

6. The device according to claim 3 wherein the retarding means comprises:

a multiple gear reduction train with a low speed input member rotated by the drum during descent, and a plurality of intermediate members sized to successively increase rotational speed to a highest speed member, the highest speed member being weighted so as to prevent the user's weight from accelerating the drum's rotational speed faster than a selected descent speed.

7. In an escape device for allowing a user to descend from a damaged structure, of the type having a carriage, a drum mounted on an axle in the carriage for rotation with respect to the carriage, a cable wound around the drum and having an end adapted to be secured to a part of the structure, body support means carried by the carriage for carrying the user during descent, and retarding means mounted to the carriage for limiting the rotational speed of the drum during descent of the carriage and user, the improvement comprising:

an input shaft mounted to the retarding means;

an arm mounted to the drum for rotation with the drum, the arm extending perpendicualar to the axle and having a free end with a finger protruding away from the drum perpendicular to the drum; and a coil spring aligned in a plane normal to the axle, having its inner end secured to the input shaft for rotation therewith, and its outer end in engagement with the finger, whereby rotation of the drum rotates the finger, the coil spring, and the input shaft of the retarding means, jerks in the cable being absorbed to an extent by the resiliency of the coil spring.

8. The device according to claim 7 wherein the outer end of the coil spring is formed in a configuration of a hook for engaging the finger.

9. An escape device for allowing the user to descend from a damaged structure comprising in combination:

a housing having a first compartment and a second compartment separated from each other by a partition, the second compartment having a door releasably mounted to the housing;

a drum rotatably carried in the first compartment and having an output member that rotates with the drum;

a cable wound around the drum and having an end adapted to be secured to a part of the structure;

a strap having its ends secured to the housing, defining a loop for the user to place about his body for descending with the housing, the strap being foldable inside the second compartment;

fastening means for releasably securing the door to the housing in a closed position, the fastening means being actuable to release the door to expose the strap for use;

retarding means mounted inside the first compartment for limiting the rotational speed of the drum during descent, the retarding means including a multiple gear reduction train with a low speed input member rotated by the drum during descent and a plurality of intermediate members sized to successively increase rotational speed to a highest speed member, the highest speed member being weighted so as to prevent the user's weight from accelerating the drum's rotational speed faster than a selected descent speed; and shock absorber means forming the connection between the drum output member and the retarding means input member for absorbing shock due to jerking of the cable to reduce the shock being transmitted to the retarding means.

10. The device according to claim 9 wherein the second compartment is located below the first compartment, with the door being hingedly connected to the housing and forming the bottom of the second compartment.

11. The device according to claim 9 wherein the shock absorber means comprises a coil spring.

12. In an escape device for allowing a user to descend from a damaged structure, of the type having a carriage, a drum rotatably mounted to the carriage, a cable wound around the drum and having an end adapted to be secured to a part of the structure, and body support means carried by the carriage for carrying the user during descent, an improved retarding means for limiting the rotational speed of the drum during descent of the carriage and the user, comprising:

a multiple gear reduction train having a shaft mounted in engagement with the drum for rotation therewith, a plurality of intermediate pinions and gears sized to successively increase rotational speed to a highest speed member that has an axis of rotation about which it is rotated, the ratio of the gear reduction train and the weight alone of the highest speed member preventing the user's weight from accelerating the drum's rotational speed faster than a selected descent speed.

13. The device according to claim 12 wherein the highest speed member is free of any drag creating structure.

14. The device according to claim 13 wherein the highest speed member consists entirely of a cylinder mounted for rotation about its longitudinal axis.

* * * * *